US006343460B1

(12) United States Patent
Fujikawa et al.

(10) Patent No.: US 6,343,460 B1
(45) Date of Patent: Feb. 5, 2002

(54) PACKAGING MACHINE

(75) Inventors: Yasuji Fujikawa; Kazuo Abe; Michio Ueda, all of Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/427,690

(22) Filed: Oct. 27, 1999

(30) Foreign Application Priority Data

Oct. 29, 1998 (JP) ..... 10-308123

(51) Int. Cl.[7] ..... B65B 43/42
(52) U.S. Cl. ..... 53/575; 493/184
(58) Field of Search ..... 53/567, 575, 579, 53/377.2, 377.5, 378.3; 493/70, 80, 165, 184, 452

(56) References Cited

U.S. PATENT DOCUMENTS 4,481,754 A * 11/1984 Hannen ..... 53/567
4,515,580 A 5/1985 Lovelace ..... 493/183
5,234,398 A 8/1993 Larsen ..... 493/183
5,819,501 A * 10/1998 Albrecht et al. ..... 53/226
5,893,259 A * 4/1999 Posge ..... 53/448

FOREIGN PATENT DOCUMENTS

JP 58-215338 12/1983

* cited by examiner

*Primary Examiner*—Peter Vo
*Assistant Examiner*—John Paradiso
(74) *Attorney, Agent, or Firm*—Armstrong, Westerman, Hattori, McLeland & Naughton, LLP

(57) ABSTRACT

A packaging machine includes a bottom breaker which has first to third prefolding members (41) to (43). The third prefolding member (43), serving to prefold a fold forming portion (27) by bending this portion (27) outward along a base part thereof, is pivotally movable from a nonoperative position P0 to a second operative position P2 via a first operative position P1. The fold forming portion (27) is moved with a first bottom panel (21) by the operation of the second prefolding member (42) so as to be brought into contact with the third prefolding member (43) and thereby bent outward while the third prefolding member (43) is pivotally moved from the nonoperative position P0 toward the first operative position P1. The third prefolding member (43) is pivotally moved from the first operative position P1 toward the second operative position P2 after the operation of the second prefolding member (42) to thereby bend the fold forming portion (27) through an increased angle.

4 Claims, 9 Drawing Sheets

PACKAGING MACHINE

BACKGROUND OF THE INVENTION

The present invention relates to packaging machines for containers such as cartons for containing milk, and more particularly to packaging machines including a bottom breaker.

As disclosed, for example, in JP-A 58-215338, packaging machines of the type mentioned are already known for use with tubular containers of square to rectangular cross section. The containers each have a bottom forming portion comprising first to fourth bottom panels continuous with one another, the first bottom panel having a pair of cuts formed in the center of the outer end thereof to provide a fold forming portion between these cuts for preventing a liquid from permeating the end. The packaging machine comprises a rotor having radial mandrels and intermittently drivable so as to stop each of the mandrels at a process station, the container being fitted around the mandrel with the first and third bottom panels facing toward a direction orthogonal to the direction of movement of the mandrel, and a bottom breaker for prefolding the bottom forming portion of the container as fitted around the mandrel stopped at the station so as to render the bottom forming portion foldable flat. The bottom breaker has a pair of first prefolding members which are free to open and close, and a pair of second prefolding members which are free to open and close. The second and fourth bottom panels are folded first by the movement of the first prefolding members from an open position toward a closed position, and the first and third bottom panels are folded subsequently by the movement of the second prefolding members from an open position toward a closed position. The bottom breaker further has a third prefolding member for prefolding the fold forming portion by bending this portion outward along the base part thereof. The third prefolding member is movable on the axis of the mandrel as stopped at the process station toward and away from the bottom forming portion fitted around the mandrel. When moving toward the bottom forming portion, the third prefolding member bends the fold forming portion by coming into striking contact therewith. The third prefolding member is operated by the same actuator as used for operating the first and second prefolding members.

With the conventional machine, the fold forming portion is bent by the straight movement of the third prefolding member, can not therefore be prefolded or bent effectively and is likely to restore itself from the bent form to the original state owing to the property of the container material to spring back. A faulty bottom portion will then be formed.

Further if the third prefolding member is to be reciprocatingly moved straight, a relatively great cycle time is required which is not suited to the high-speed operation of the packaging machine.

Further because a single actuator is used in common for the first to third prefolding members, it is impossible to bring the third prefolding member only out of operation. This means that containers having no fold forming portion can not be produced by the machine.

SUMMARY OF THE INVENTION

An object of the present invention is to overcome the above problems and to provide a packaging machine by which the fold forming portion can be bent to a full extent and which is adapted for a high-speed operation, the machine further being adapted to discontinue the fold forming portion bending operation only.

The present invention provides a packaging machine for tubular containers of square to rectangular cross section, each of the containers having a bottom forming portion comprising first to fourth bottom panels continuous with one another, the first bottom panel being formed with a fold forming portion in a center of an outer end thereof for preventing a liquid from permeating the end, the packaging machine comprising: a movable body having mandrels and intermittently drivable so as to stop each of the mandrels at a process station, the container being fitted around the mandrel with the first and third bottom panels facing toward a direction orthogonal to the direction of movement of the mandrel, and a bottom breaker for prefolding the bottom forming portion of the container as fitted around the mandrel stopped at the station so as to render the bottom forming portion foldable flat, the bottom breaker having a first prefolding member and a second prefolding member, the first prefolding member being operable to fold the second and fourth bottom panels initially, the second prefolding member being operable to fold the first and third bottom panels subsequently, the bottom breaker further having a third prefolding member for prefolding the fold forming portion by bending the fold forming portion outward along a base part thereof, the third prefolding member being pivotally movable from a nonoperative position to a second operative position via a first operative position, the fold forming portion being movable with the first bottom panel by the operation of the second prefolding member so as to be brought into contact with the third prefolding member and thereby bent outward while or after the third prefolding member is pivotally moved from the nonoperative position toward the first operative position, the third prefolding member being pivotally movable from the first operative position toward the second operative position after the operation of the second prefolding member to thereby bend the fold forming portion through an increased angle.

With the packaging machine of the present invention, the third prefolding member is pivotally movable from a nonoperative position to a second operative position via a first operative position. The fold forming portion is moved with the first bottom panel by the operation of the second prefolding member so as to be brought into contact with the third prefolding member and thereby bent outward while the third prefolding member is pivotally moved from the nonoperative position toward the first operative position. The third prefolding member is pivotally moved from the first operative position toward the second operative position after the operation of the second prefolding member to thereby bend the fold forming portion through an increased angle. Accordingly, the fold forming portion is bent by two steps, i.e., by the first step of bending this portion utilizing the movement of the first bottom panel by the operation of the second prefolding member, and the second step of bending the portion by the pivotal movement of the third prefolding member. Consequently, the fold forming portion can be bent to a full extent.

Further the movement of the third prefolding member is pivotal and therefore makes it possible to operate the packaging machine at a high speed.

With the packaging machine described above, the first bottom panel of the bottom forming portion of the container fitted around the mandrel stopped at the station faces to the right, and the third prefolding member is in the form of an arm having a center of pivotal movement to the right of the axis of the same mandrel at a predetermined distance therefrom and extending leftward from the center, the third prefolding member having a downward projection between left and right ends of a lower edge thereof, a folding guide face extending leftward from a base of the projection, and a fortified folding face extending upward from a left end of the folding guide face, the fold forming portion being movable with the first bottom panel by the operation of the second prefolding member to move past the projection of the third prefolding member in the first operative position upon coming into striking contact with the projection and to thereafter move along the folding guide face from a right end thereof to a left end thereof, the distance from the center of pivotal movement of the third prefolding member to the part of the first bottom panel adjacent to the fold forming portion being approximately equal to the radius of pivotal movement of the fortified folding face when the second prefolding member is in an operative position. The fold forming portion can then be bent to lap over the portion of the first bottom panel adjacent to the base part of the fold forming portion.

When the third prefolding member is adapted to be operated by an actuator different from an actuator for operating the first and second prefolding members, the third prefolding member only can be brought out of operation. This renders the packaging machine usable for producing any container regardless of whether the container has the fold forming portion.

Further when the actuator for operating the third prefolding member is a fluid pressure cylinder having a two-step stroke, the third prefolding member can be moved in two steps readily and reliably.

DESCRIPTION OF THE PREFERRED EMBODIMENT

An embodiment of the present invention will be described next with reference to the drawings.

In the following description, the terms "front" and "rear" refer respectively to the left-hand side and the right-hand side of FIG. 1, and the terms "left" and "right" are used for the machine as it is seen from the rear forward.

Figure 8:
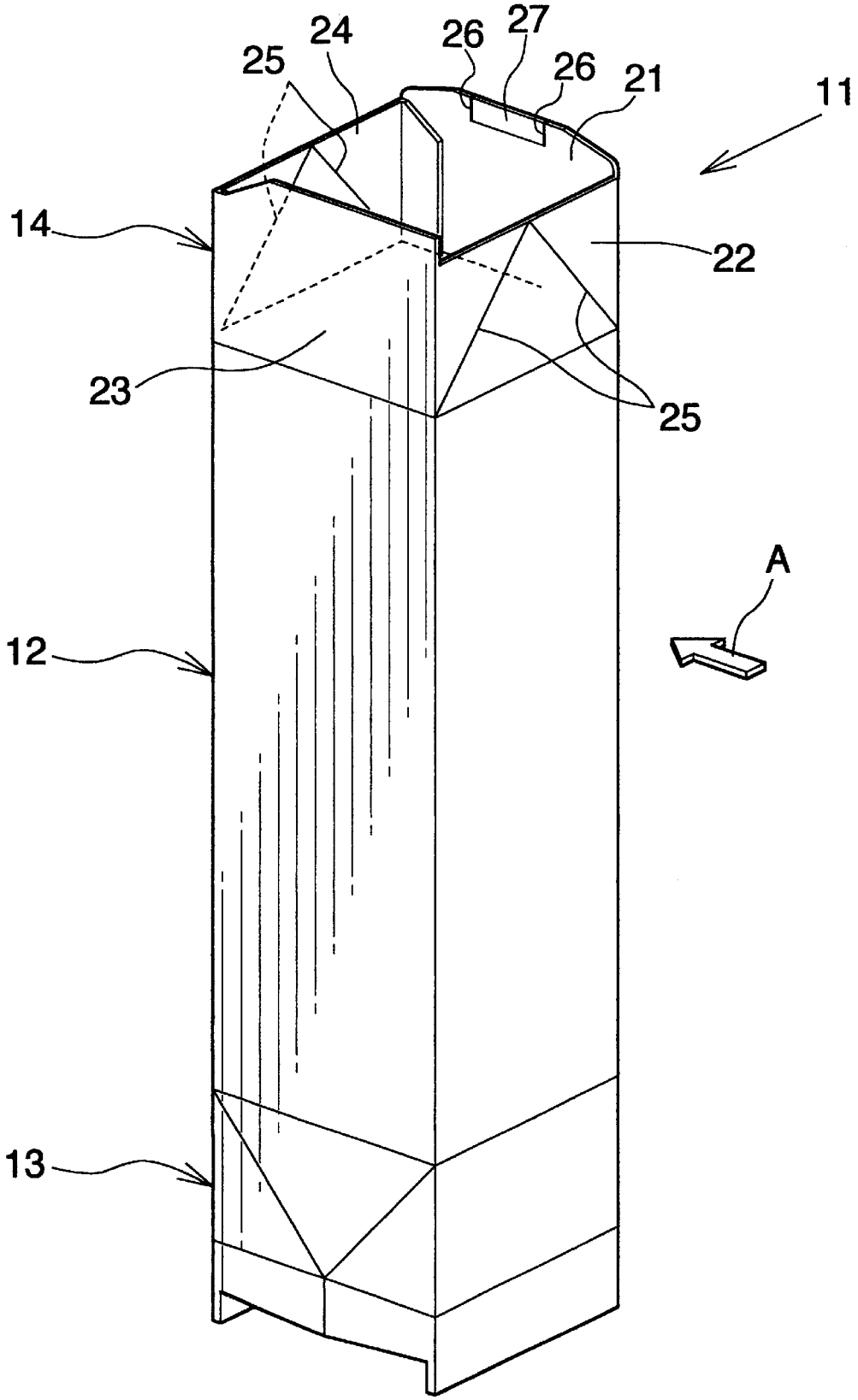
FIG. 8 is a perspective view of a container for use in the packaging machine.

FIG. 8 shows a container 11 as turned upside down. The container 11 comprises a trunk forming portion 12 to be made into a trunk, a top forming portion 13 to be made into a top portion, and a bottom forming portion 14 to be made into a bottom portion.

The bottom forming portion 14 comprises first to fourth rectangular bottom panels 21 to 24 joined to one another endlessly. The second and fourth bottom panels 22, 24 are each formed with an inverted V-shaped score 25. The first bottom panel 21 is formed in the center of its outer end with a pair of cuts 26 extending in parallel to the axis of the container. The portion between the cuts 26 provides a fold forming portion 27 for preventing penetration of liquid into the end face.

The bottom forming portion 14 is folded in the following manner. First, the second and fourth bottom panels 22, 24 are folded inward while being folded each in two along the score 25, and the first and third bottom panels 21, 23 are then folded over the second and fourth bottom panels 22, 24 thus folded. The outer end portion of the first bottom panel 21 including the fold forming portion 27 is inserted between the third bottom panel 23 and triangular portions of the second bottom panel 22 and the fourth bottom panel 24. In this case, the fold forming portion 27 is folded over the portion of the panel 21 adjoining the base part of the portion 27 before the insertion.

Figure 9:
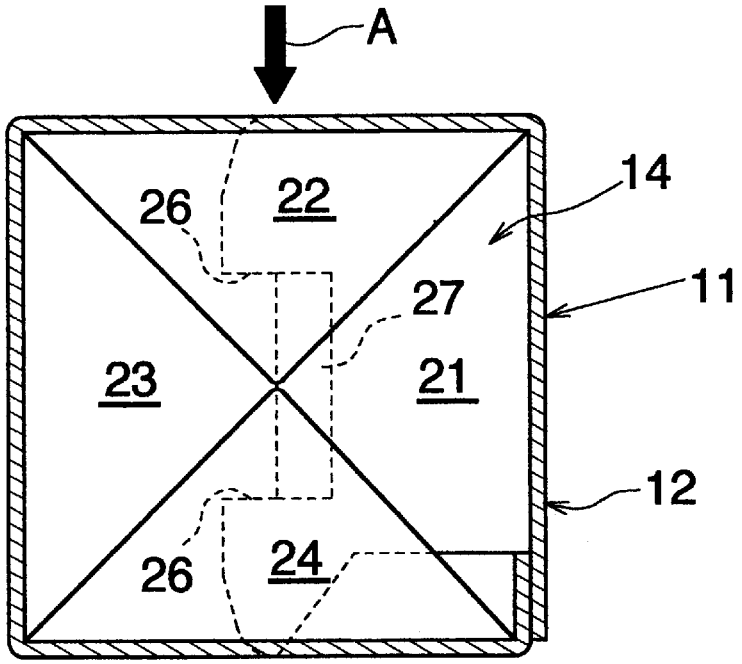
FIG. 9 is a plan view of the bottom portion of the container as it is seen from inside after folding.
Figure 10:
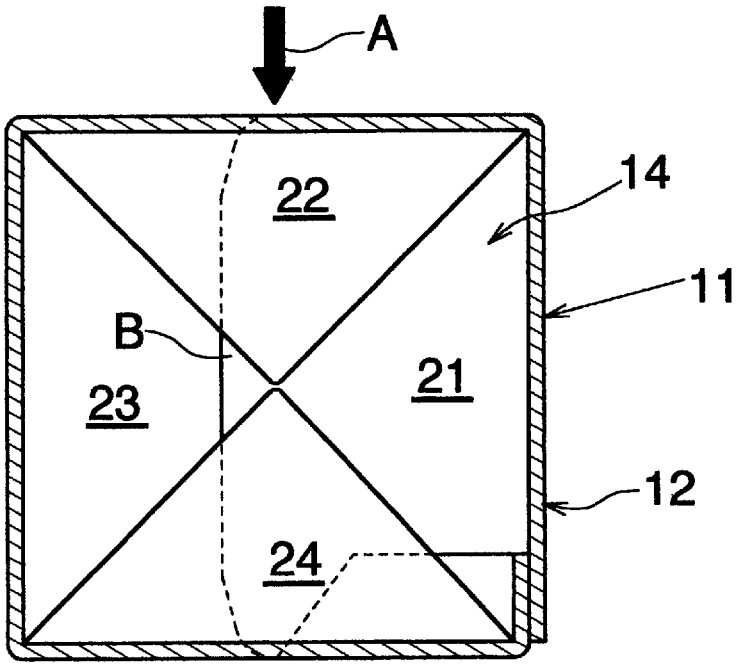
FIG. 10 is a plan view corresponding to FIG. 9 and showing a container bottom portion having a different structure.

FIG. 9 shows the bottom forming portion 14 eventually folded flat as it is seen from inside the container. If the first bottom panel 21 had no fold forming portion 27 as seen in FIG. 10, the portion B of the panel 21 corresponding to the portion 27 would be exposed inside the container between the folded-over triangular portions of the second and fourth bottom panels 22, 24. After the container is filled with a liquid, the liquid would then permeate the end face of the portion B corresponding to the fold forming portion 27 of the first bottom panel 21. However, the fold forming portion 27, which is folded over as described above, is covered with the first bottom panel 21 and the folded-over triangular portions of the second and fourth bottom panels 22, 24, whereby the liquid is prevented from permeating the portion 27.

Figure 1:
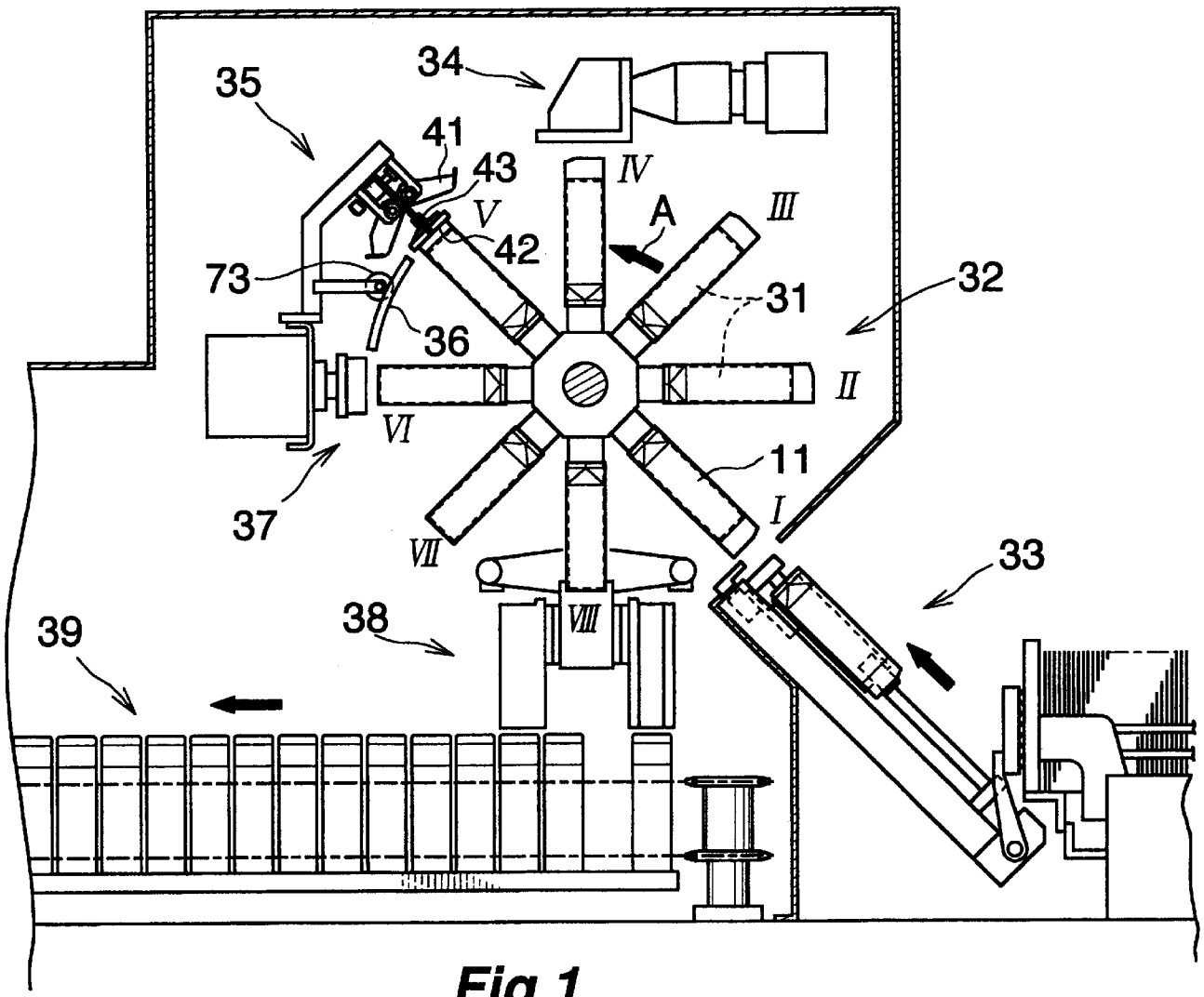
FIG. 1 is a side elevation of a packaging machine of the invention.

FIG. 1 shows a packaging machine which comprises an intermittently drivable rotor 32 having eight radial mandrels 31 so arranged as to revolve counterclockwise as indicated by an arrow A in FIG. 1 and successively stop at eight stations, i.e., first to eighth process stations I to VIII, a feeder 33 disposed at the first process station I, a bottom heater 34 disposed at the fourth process station IV, a bottom breaker 35 disposed at the fifth process station V, a folding rail 36 extending from the fifth process station V to the sixth process station VI, a bottom press 37 disposed at the sixth process station VI, an unloader 38 disposed at the eighth station VIII and a container conveyor 39 having the starting end of a path of transport at the eighth station VIII.

The second, third and seventh process stations II, III and VII are all idle stations. A preheater and other devices are provided at the idle stations.

The direction of revolution of the mandrel is indicated by an arrow A in FIG. 8. The container 11 is fitted around the mandrel 31 with its bottom forming portion 14 projecting therefrom and with the first bottom panel 21 facing to the right.

Figure 2:
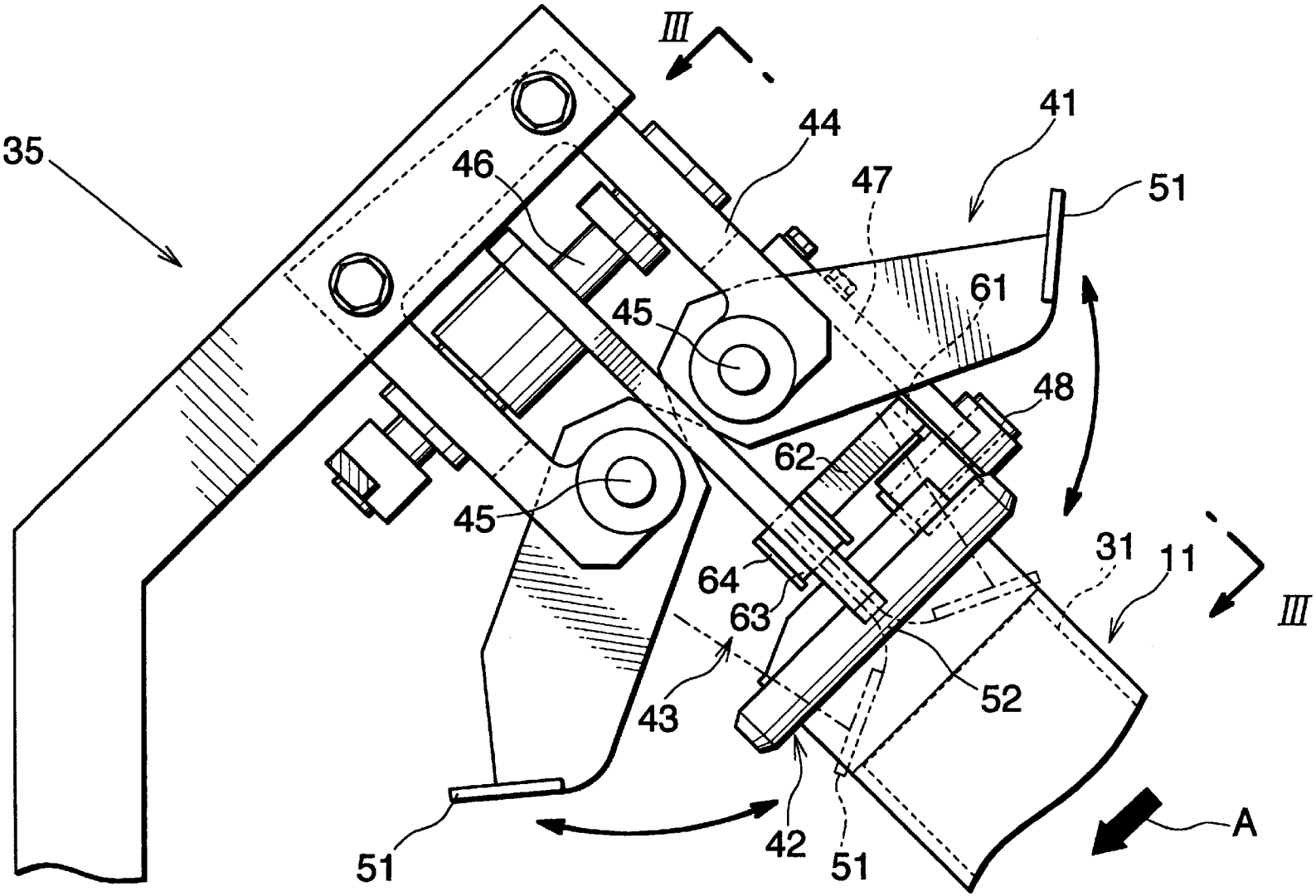
FIG. 2 is a side elevation of a bottom breaker of the packaging machine.
Figure 3:
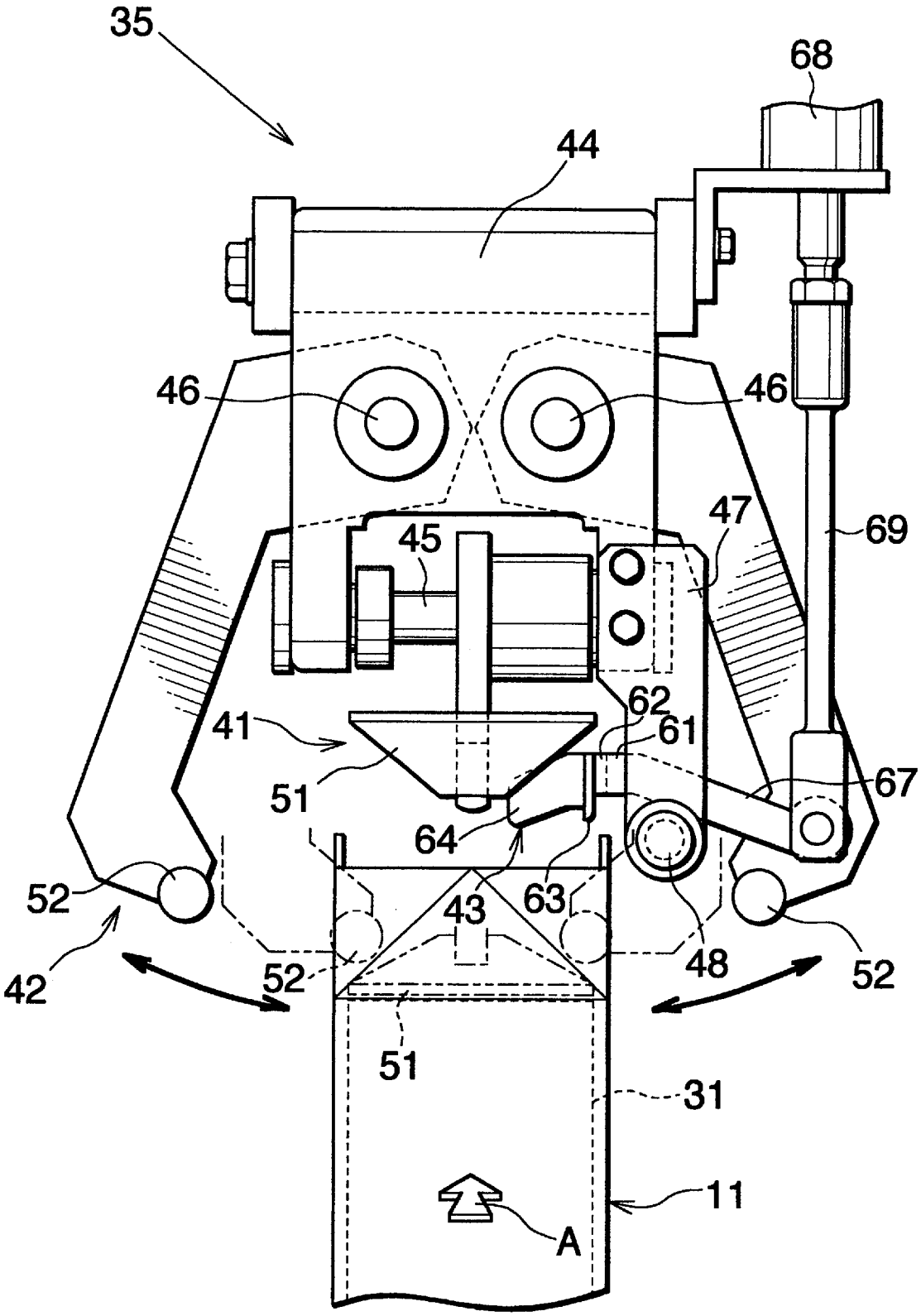
FIG. 3 is a view of the same as it is seen in the direction of arrows of the line III—III in FIG. 2.
Figure 4:
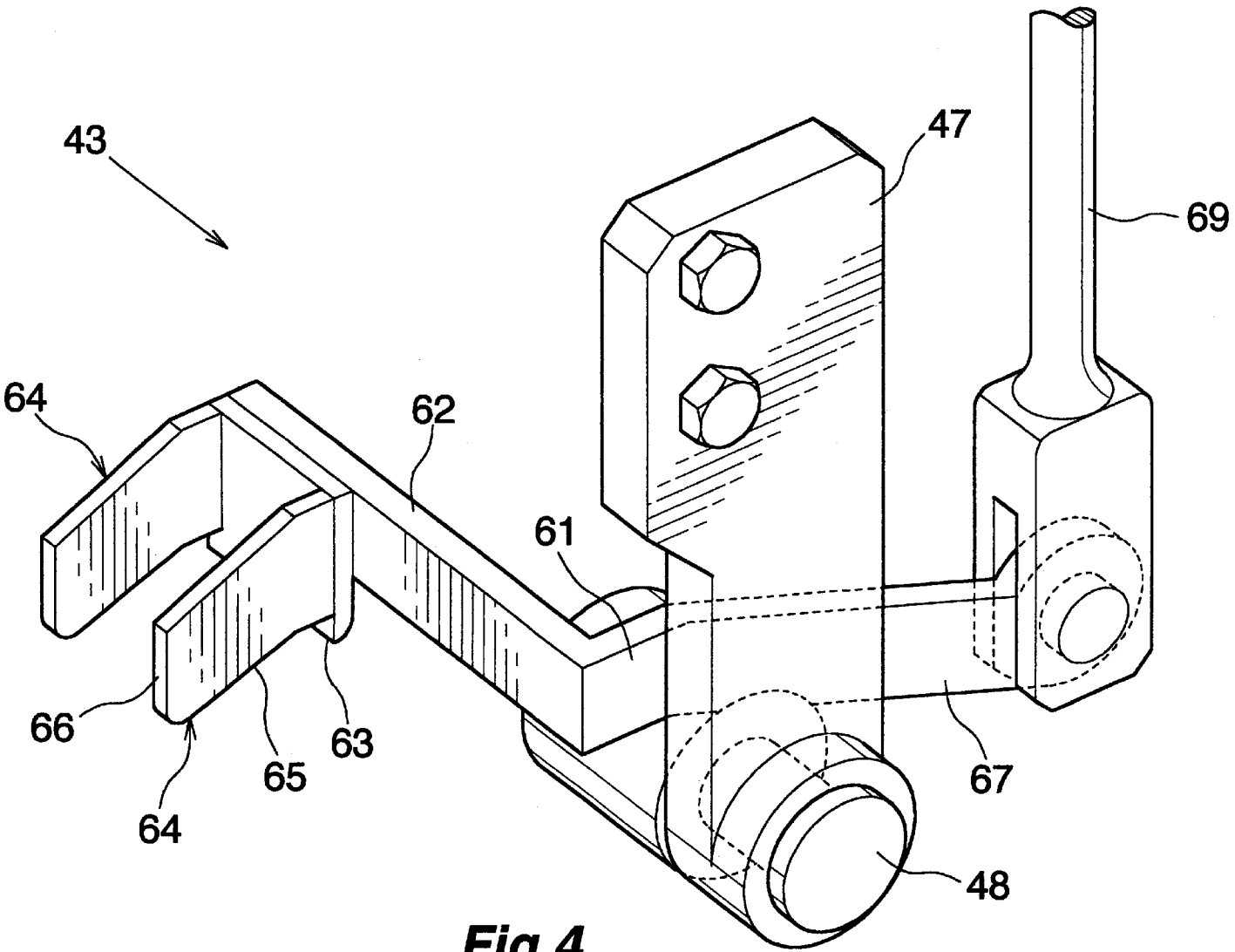
FIG. 4 is a perspective view of a third prefolding member included in the bottom breaker.

As shown in detail in FIGS. 2 and 3, the bottom breaker 35 comprises a pair of first prefolding members 41 to be opened and closed in the direction of movement of the mandrel at the fifth station V, a pair of second prefolding members 42 to be opened and closed orthogonally of the direction of movement of the mandrel at the fifth station V, and a third prefolding member 43 pivotally movable about an axis extending in a direction across, and at the right of, the axis of the mandrel 31 stopped at the fifth station V.

A yoke 44 secured to a machine frame by suitable means is provided externally of the mandrel 31 as halted at the fifth station V. Supported by the yoke 44 are a pair of first pivots 45 arranged side by side in the direction of movement of the mandrel and extending transversely of this direction, and a pair of second pivots 46 extending transversely of these pivots 45. The yoke 44 is further provided with a bracket 47 extending obliquely downward in the rear of the second prefolding member 42 at the right. Mounted on the lower end of the bracket 47 is a support rod 48 extending in parallel to the second pivots 46.

The first prefolding members 41 are in the form of arms extending inward from the respective first pivots 45 and each have a triangular pressure plate 51 at the inward end. The second prefolding members 42 are in the form of arms extending inward from the respective second pivots 46 and each have a round pressure bar 52 at the inward end. The first pivots 45, as well as the second pivots 46, are rotated in directions opposite to each other reversibly by unillustrated drive means. As a result, the first prefolding members 41 are opened and closed to move their pressure plates 51 away from and toward each other, and the pressure bars 52 of the second prefolding members 42 are also similarly moved. When closed, the first prefolding members 41 have their pressure plates 51 brought into pressing contact with the second and fourth bottom panels 22, 24, respectively, and the second prefolding members 42 have their pressure bars 52 into pressing contact with the first and third bottom panels 21, 23.

The third prefolding member 43 is in the form of an L-shaped arm attached to the support rod 48 as if extending across the first bottom panel 21 of the bottom forming portion 14 of the container 11 as fitted around the mandrel 31 halted at the fifth station V. The member 43 comprises a base-end arm portion 61 in the form of a strip and extending leftward from the support rod 48, and an outer-end arm portion 62 in the form of a strip and obliquely extending forwardly downward from the outer end of the arm portion 61.

The outer-end arm portion 62 is provided with a wide portion 63 extending downward from the outer end thereof, and a pair of arms 64 extending leftward in parallel to each other from the wide portion 63 and orthogonal thereto. The distance between the two arms 64 is slightly smaller than the width of the fold forming portion 27. The lower end of the wide portion 63 projects downward beyond the base parts of the arms 64. The arms 64 have lower faces providing a folding guide face 65, and outer ends providing a fortified folding face 66. The folding guide face 65 and the fortified folding face 66 make an angle of about 90 deg.

The third prefolding member 43 has an arm extension 67 projecting rightward from its base portion. The right end of the extension 67 is connected to the piston rod 69 of a fluid pressure cylinder 68 mounted on the yoke 44 and directed downward. The cylinder 68 is of the two-step stroke type.

Figure 5A:
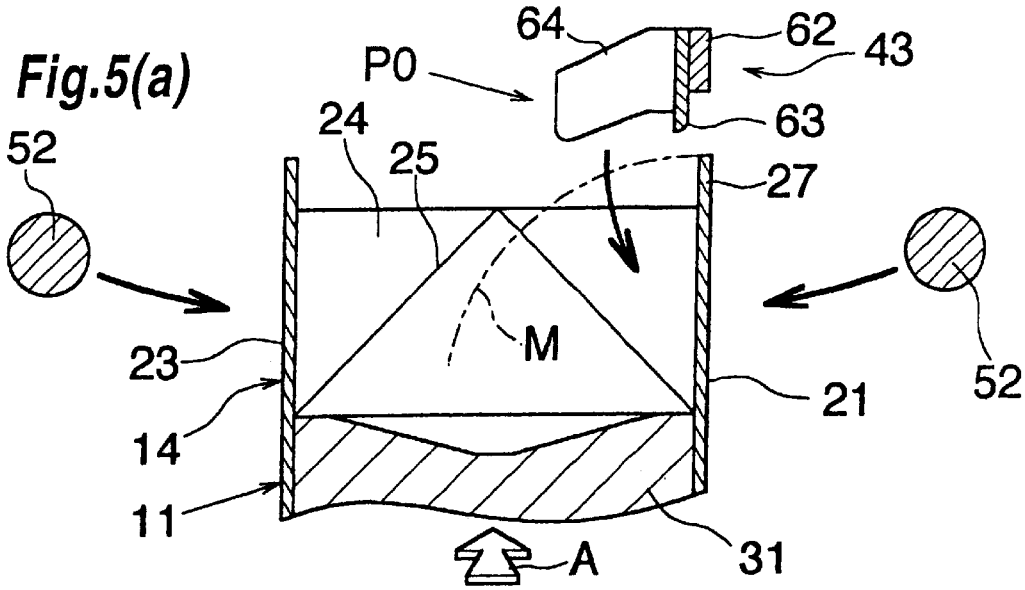
FIG. 5 includes diagrams for illustrating the folding operation of the bottom breaker.
Figure 5B:
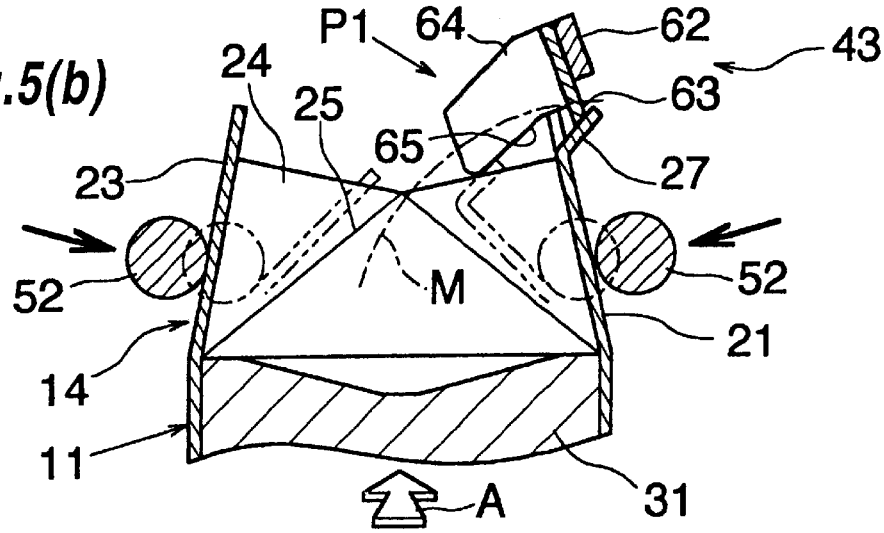
Figure 5C:
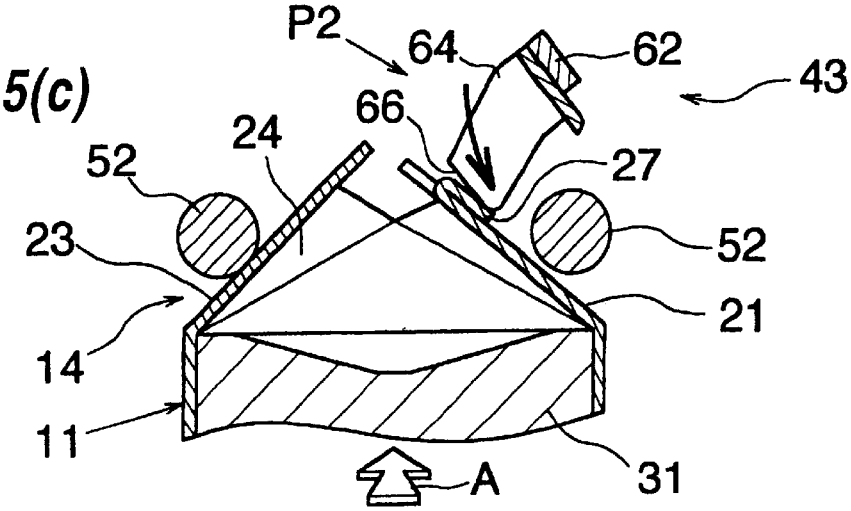

With reference to FIG. 5, the third prefolding member 43 is in a nonoperative position P0 (a) when the cylinder 68 is in an advanced position, the member 43 is in a first operative position P1 (b) when the cylinder 68 is a first stroke position, and the member 43 is in a second operative position P2 (c) when the cylinder 68 is in a second stroke position.

When the container 11 is to be fed to the fifth station V, the first and second prefolding members 41, 42 are each in the open position, with the third prefolding member 43 in its nonoperative position P0. The third prefolding member 43 in the nonoperative position P0 is positioned externally of the bottom forming portion 14 of the container 11.

When the container 11 is delivered to the fifth station V, the piston rod 69 of the cylinder 68 is moved to the first stoke position, bringing the third prefolding member 43 to the first operative position P1. Subsequently, the first and second prefolding members 41, 42 start to move from the open position toward the closed position at the same time. In the course of this movement, the first prefolding members 41 first inwardly fold the second and fourth bottom panels 22, 24 along the respective scores 25, and the second prefolding members 42 then inwardly fold the first and second bottom panels 21, 23 over the folded second and fourth bottom panels 22, 24.

FIG. 5, sections (a) and (b) show a curve M representing the path of movement of outer end of the first bottom forming panel 21 during folding. The third prefolding member 43 moves across this curve M. The folding guide face 65 moves away from the path M inwardly thereof as the guide face 65 advances. Accordingly, when the first bottom panel 21 is moved toward a closed position with the third prefolding member 43 in the first operative position P1, the fold forming portion 27 collides with the projecting lower end of wide portion 63 of the third prefolding member 43 and is bent rightward along the base part thereof. The fold forming portion 27 moves along the folding guide face 65 after moving past the projecting lower end of the portion 63, whereby the bending angle of the fold forming portion 27 is gradually increased.

When the second prefolding members 42 are eventually brought to the closed position shown in FIG. 5, (c), the first and third bottom panels 21, 23 are bent at an angle of about 45 deg with respect to the center line of the container, and the fold forming portion 27 is bent at an angle of about 90 deg with respect to the first bottom panel 21.

When the second prefolding members 42 are brought to the closed position, the cylinder piston rod 69 is moved to the second stroke position, whereby the third prefolding member 43 is further pivotally moved to the second operative position P2 shown in FIG. 5, (c). In this position, the fortified folding face 66 of the third prefolding member 43 is approximately in contact with the first bottom panel 21. This means that the distance from the center of pivotal movement of the third prefolding member 43 to the first bottom panel 21 in the eventual folded position is approximately equal to the radius of pivotal movement of the fortified folding face 66.

When the third prefolding member 43 is brought to the second operative position P2, the fortified folding face 66 of the member 43 presses the fold forming portion 27 against the part of the first bottom panel 21 adjacent to the base of the portion 27 to lap the portion 27 over the adjacent part. The fold forming portion 27 in its initial raised position is folded through 180 deg in this way. When the portion 27 is thus prefolded or given a folding tendency, it is unlikely that the fold will be removed from the portion 27 by the springing back of the container material.

The fluid pressure cylinder piston rod 69 is thereafter advanced by the distance of two-step stroke, pivotally moving the third prefolding member 43 upward, and the first and second prefolding members 41, 42 are moved away from the container 11.

Since the third prefolding members 43 is operated by a drive source different from that for the first and second prefolding members 42, 42, the operation timing of these members can be determined as desired, while the third prefolding member 43 only can be brought out of operation.

Figure 6:
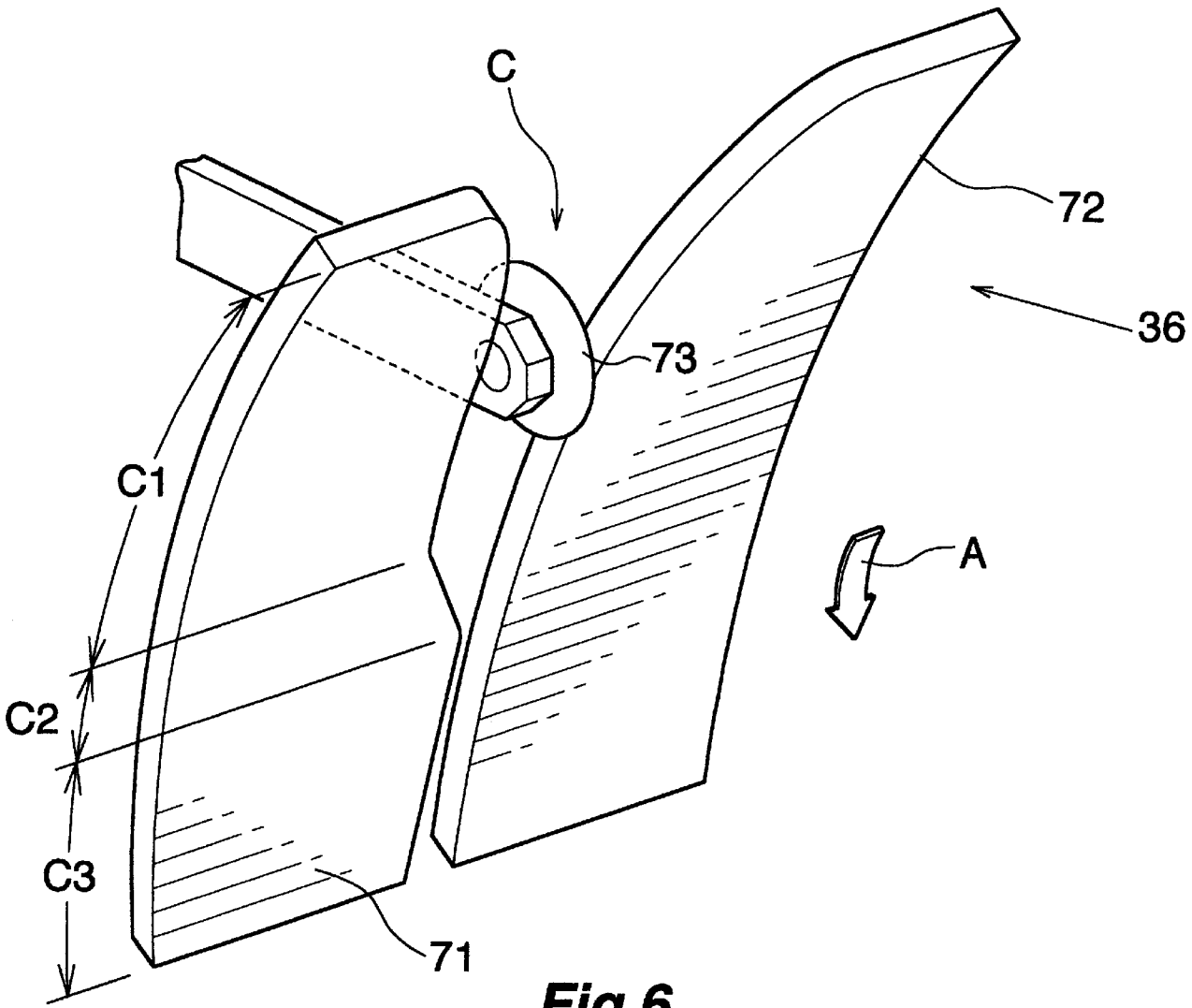
FIG. 6 is a perspective view of a folding rail and a guide member of the packaging machine.

As shown in detail in FIG. 6, the folding rail 36 comprises left and right rail members 71, 72. The rail members 71, 72 are each generally in the form of a circular-arc plate centered about the center of rotation of the rotor 32. Stated more precisely, the rail members 71, 72 are positioned closer to the center of rotation of the rotor 32 as they extend from the fifth station V toward the sixth station VI.

Formed between the two rail members 71, 72 is a clearance C for inserting the folded bottom forming portion 14 thereinto. The clearance C comprises a first section C1, second section C2 and third section C3 continuously arranged in the direction of movement of the mandrel.

Figure 7A:
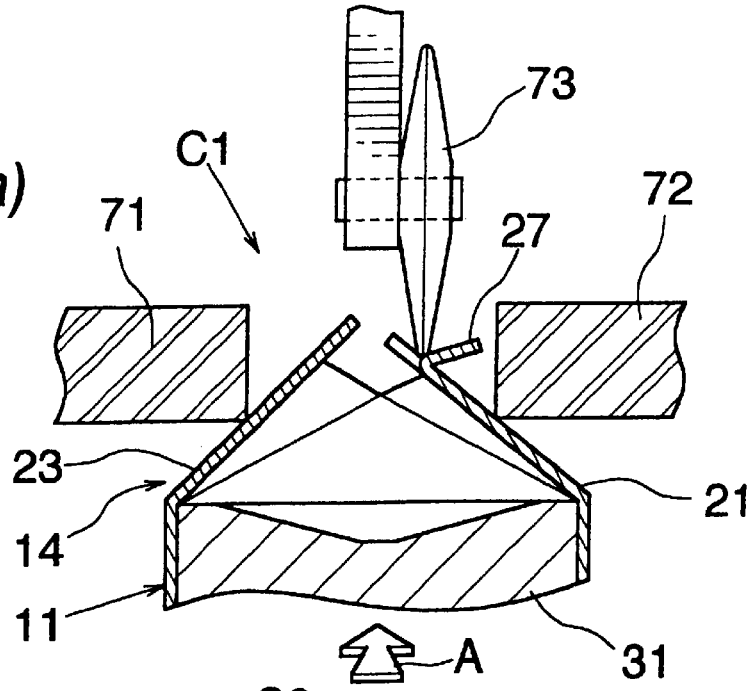
FIG. 7 includes diagrams for illustrating the folding operation of the folding rail.
Figure 7B:
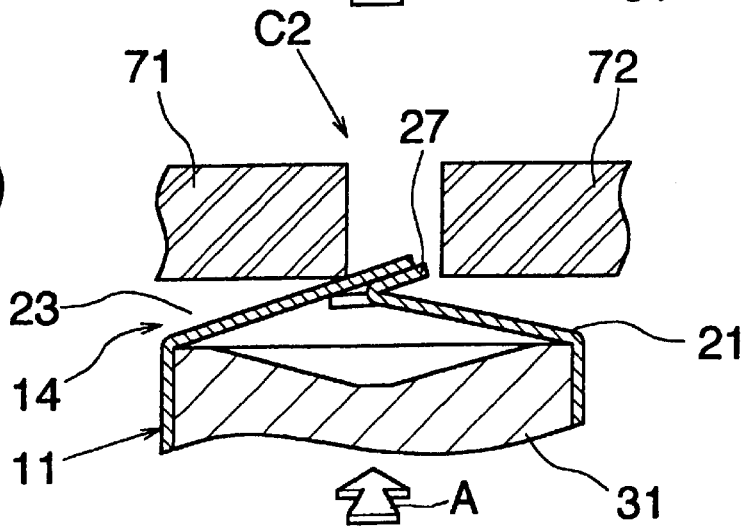
Figure 7C:
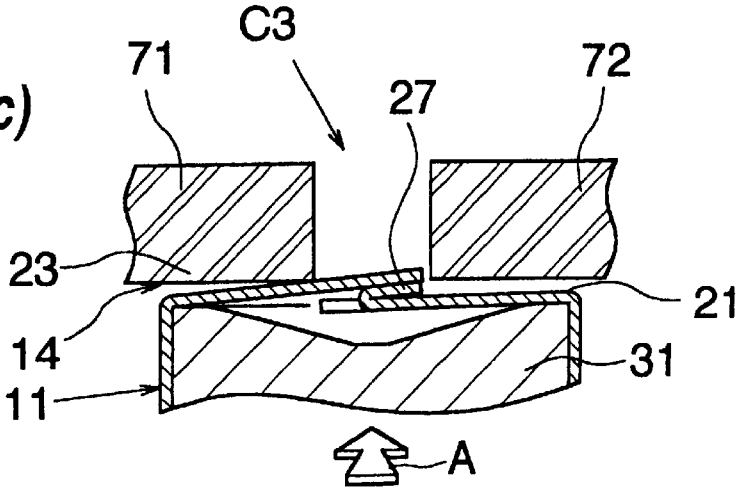

FIG. 7, sections (a), (b) and (c) show how the bottom forming portion 14 is folded as it is moved through the first to third sections C1, C2 and C3 in succession.

In the first section C1, the rail members 71, 72 start to fold the bottom forming portion 14 upon the portion 14 coming into contact with these members. In the second section C2, the portion 14 is folded to an extent that the outer end of the first bottom panel 21 is positioned beneath free end of the third bottom panel 23. The bottom forming portion 14 is folded almost flat in the third section C3.

A guide roller 73 is disposed at the approximate midportion of the first section C1. A rotary shaft for the guide roller 73 extends transversely of an extension of axis of the mandrel 31 moving past the guide roller 73. The guide roller 73 has an outer periphery positioned in the clearance C at a position slightly to the right of the path of movement of the center of the mandrel 31.

FIG. 7, (a) shows the bottom forming portion 14 as it moves past the guide roller 73. At this time, the outer periphery of the guide roller 73 is in pressing contact with the left side part of the base of the fold forming portion 27. Further before and after the fold forming portion 27 moves past the guide roller 73, the outer periphery of the guide roller 73 presses the first bottom panel 21 on extension lines of the base part of the fold forming portion 27. The fold forming portion 27 is distinctly bent from the other portion of the first bottom panel 21 by the guide roller 73 and can therefore be reliably folded as shown in FIG. 7, (b) and (c).

It is desirable that the guide roller 73, which is to be provided in the first section C1, be disposed immediately before the second section C2.

The embodiment described above can be modified variously as will be described below.

A pair of cuts are formed in the midportion of outer end portion of the first bottom panel to provide the fold forming portion between the cuts for preventing the liquid from permeating the panel end face, whereas a container is known which has a fold forming portion projecting upward from the midportion of outer end of a first bottom panel (see JP-Y No. 59-22015). The fold forming portion of such a container can be prefolded also by the third prefolding member of the invention.

Although the mandrels are arranged radially about a horizontal axis of rotation, a packaging machine is also known wherein mandrels are suspended from the peripheral portion of a horizontal rotary plate which has a vertical axis of rotation (see JP-A No. 61-127403). The invention is applicable also to this packaging machine.

Furthermore, mandrels may be disposed outwardly upright at an endless chain rotating inner vertical face.

Although the rotor shown has eight mandrels, a rotor having six mandrels is also known well.

The first prefolding members, as well as the second prefolding members, are paired and closable prefolding, whereas a bottom breaker is known which has a first prefolding member and a second prefolding member which are movable straight toward and away from the end face of the mandrel axially of the mandrel, at least one of the first and second prefolding member being adapted to prefold the container by the straight movement only without closing (see JP-U No. 3-8107). The third prefolding member can be used in combination with the first and second prefolding members thus adapted.

The guide roller may be replaced, for example, by a barlike fixed guide member extending toward the direction of movement of the container. It is then desirable that the surface of the fixed member to be brought into contact with the container be coated with Teflon. This prevents the frictional contact of the guide member with the container from producing polyethylene fragments or particles on the container surface.

What is claimed is:

1. A packaging machine for tubular containers of square to rectangular cross section, each of the containers having a bottom forming portion comprising first to fourth bottom panels continuous with one another, the first bottom panel being formed with a fold forming portion in a center of an outer end thereof for preventing a liquid from permeating the end, the packaging machine comprising:

a movable body having mandrels and intermittently drivable so as to stop each of the mandrels at a process station, the container being fitted around the mandrel with the first and third bottom panels facing toward a direction orthogonal to the direction of movement of the mandrel, and a bottom breaker for prefolding the bottom forming portion of the container as fitted around the mandrel stopped at the station so as to render the bottom forming portion foldable flat, the bottom breaker having a first prefolding member, a second prefolding member and actuator means therefor, the first prefolding member being operable to fold the second and fourth bottom panels initially, the second prefolding member being operable to fold the first and third bottom panels subsequently, the bottom breaker further having a third prefolding member for prefolding the fold forming portion by bending the fold forming portion outward along a base thereof, the third prefolding member being pivotally movable from a nonoperative position to a second operative position via a first operative position, the fold forming portion being movable with the first bottom panel by the operation of the second prefolding member so as to be brought into contact with the third prefolding member and thereby bent outward while or after the third prefolding member is pivotally moved from the nonoperative position toward the first operative position, the third prefolding member being pivotally movable from the first operative position toward the second operative position after the operation of the second prefolding member to thereby bend the fold forming portion through an increased angle.

2. A packaging machine according to claim 1 wherein the first bottom panel of the bottom forming portion of the container fitted around the mandrel stopped at the station faces to the right, and the third prefolding member is in the form of an arm having a center of pivotal movement to the right of the axis of the same mandrel at a predetermined distance therefrom and extending leftward from the center, the third prefolding member having a downward projection between left and right ends of a lower edge thereof, a folding guide face extending leftward from a base of the projection, and a fortified folding face extending upward from a left end of the folding guide face, the fold forming portion being movable with the first bottom panel by the operation of the second prefolding member to move past the projection of the third prefolding member in the first operative position upon coming into striking contact with the projection and to thereafter move along the folding guide face from a right end thereof to a left end thereof, the distance from the center of pivotal movement of the third prefolding member to the part of the first bottom panel adjacent to the fold forming portion being approximately equal to the radius of pivotal movement of the fortified folding face when the second prefolding member is in an operative position.

3. A packaging machine according to claim 1 or 2 wherein the third prefolding member is operated by an actuator different from said actuator means for operating the first and second prefolding member.

4. A packaging machine according to claim 3 wherein the actuator for operating the third prefolding member is a fluid pressure cylinder having a two-step stroke.

* * * * *